US008092201B2

(12) United States Patent
Tsukahara et al.

(10) Patent No.: US 8,092,201 B2
(45) Date of Patent: Jan. 10, 2012

(54) VANE PUMP WITH COATED VANES

(75) Inventors: Yoshihiro Tsukahara, Tochigi (JP); Tomohiro Tanaka, Tochigi (JP)

(73) Assignee: Showa Corporation, Gyoda-Shi (JP)

( * ) Notice: Subject to any disclaimer, the term of this patent is extended or adjusted under 35 U.S.C. 154(b) by 738 days.

(21) Appl. No.: 12/211,856

(22) Filed: Sep. 17, 2008

(65) Prior Publication Data

US 2009/0136374 A1 May 28, 2009

(30) Foreign Application Priority Data

Nov. 28, 2007 (JP) ..... 2007-308044

(51) Int. Cl.
*F01C 21/00* (2006.01)
*F04C 15/00* (2006.01)
*F04C 29/00* (2006.01)

(52) U.S. Cl. ..... 418/178; 418/179; 418/235

(58) Field of Classification Search ..... 418/178, 418/179, 235

See application file for complete search history.

(56) References Cited

U.S. PATENT DOCUMENTS

| | | | | | |
|---|---|---|---|---|---|
| RE24,932 | E | * | 1/1961 | Davey | 418/178 |
| 3,778,201 | A | * | 12/1973 | Caffrey | 418/178 |
| 4,944,663 | A | * | 7/1990 | Iizuka et al. | 418/178 |
| 5,021,629 | A | * | 6/1991 | Shimomura | 418/178 |
| 5,263,834 | A | * | 11/1993 | Sato et al. | 418/178 |
| 5,573,390 | A | * | 11/1996 | Takeuchi et al. | 418/178 |
| 6,299,425 | B1 | * | 10/2001 | Hirano et al. | 418/178 |
| 6,413,061 | B1 | * | 7/2002 | Esumi et al. | 418/178 |
| 6,435,850 | B2 | * | 8/2002 | Sunaga et al. | 418/178 |
| 6,666,671 | B1 | * | 12/2003 | Olver et al. | 418/178 |

FOREIGN PATENT DOCUMENTS

| | | |
|---|---|---|
| JP | 3112529 | 6/1993 |
| JP | 2001-32781 | 2/2001 |

* cited by examiner

*Primary Examiner* — Mary A Davis
(74) *Attorney, Agent, or Firm* — Babcock IP, PLLC

(57) ABSTRACT

Provided is a vane pump. In the vane pump, a high-hardness main coating layer is provided on a distal end portion of each vane, and an intermediate coating layer having an intermediate hardness between a hardness of a base material of the vane and a hardness of the main coating layer is provided between the base material of the vane and the main coating layer.

16 Claims, 4 Drawing Sheets

VANE PUMP WITH COATED VANES

BACKGROUND OF THE INVENTION

1. Field of the Invention

The present invention relates to a vane pump.

2. Description of the Related Art

In a vane pump disclosed in Japanese Patent Application Laid-Open (JP-A) No. 2001-32781 (Patent Document 1), vanes are received in grooves formed at a plurality of circumferential positions of a rotor fixed to a pump shaft, and distal end portions of the vanes are pressed and slid on a cam ring.

In addition, in a rotary compressor disclosed in Japanese Patent No. 3112529 (Patent Document 2), a titanium nitride coating layer (TiN) is deposited on distal end portions of vanes.

In the vane pump disclosed in Patent Document 1, as shown in FIG. 5, when the titanium nitride coating layer (TiN) disclosed in Patent Document 2 is formed on the distal end portion of the vane, since a difference in hardness between a base material A of the vane, for example, a high speed tool steel (SKH51) (hardness: 770 to 940 HV) and the titanium nitride coating layer (hardness: 2000 to 2500 HV, 2.6 times the hardness of the base material) is large, an adhesion therebetween is low. In addition, since the titanium nitride coating layer may be peeled off, an abrasion resistance of the vane is deteriorated.

SUMMARY OF THE INVENTION

An object of the present invention is to provide a vane pump in which an adhesion characteristic of a high-hardness coating layer formed on distal end portions of vanes and an abrasion resistance and durability of the vanes are improved.

The present invention relates to a vane pump in which vanes are received into grooves formed at a plurality of circumferential positions of a rotor fixed to a pump shaft, and distal end portions of the vanes are pressed and slid on a cam ring. When a high-hardness main coating layer is formed on the distal end portion of each of the vanes, an intermediate coating layer having an intermediate hardness between a hardness of a base material of the vane and a hardness of the main coating layer is formed between the base material of the vane and the main coating layer.

BRIEF DESCRIPTION OF THE DRAWINGS

The present invention will be more fully understood from the detailed description given below and from the accompanying drawings which should not be taken to be a limitation on the invention, but are for explanation and understanding only.

DESCRIPTION OF THE PREFERRED EMBODIMENTS

Figure 1:
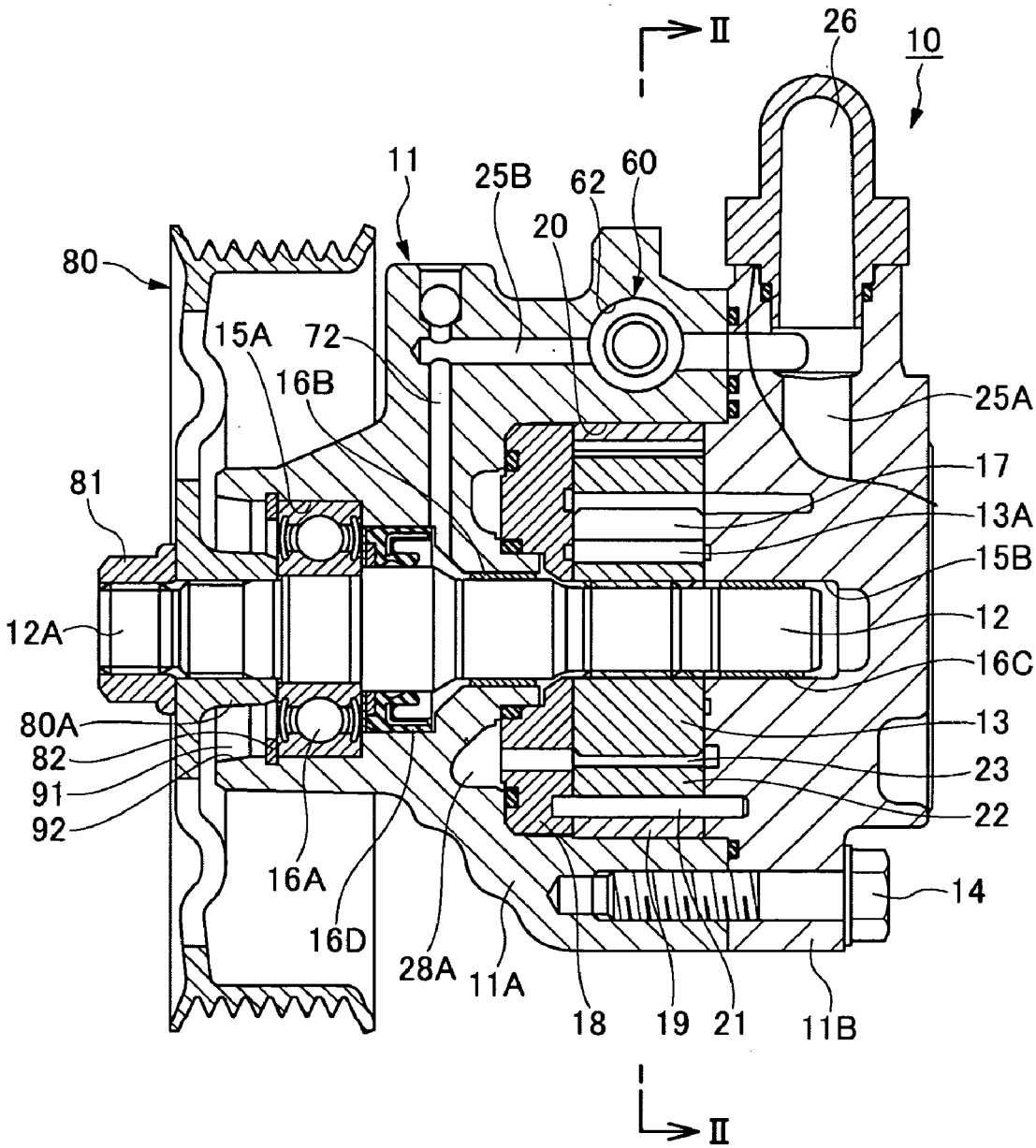
FIG. 1 is a cross-sectional view showing a vane pump.
Figure 2:
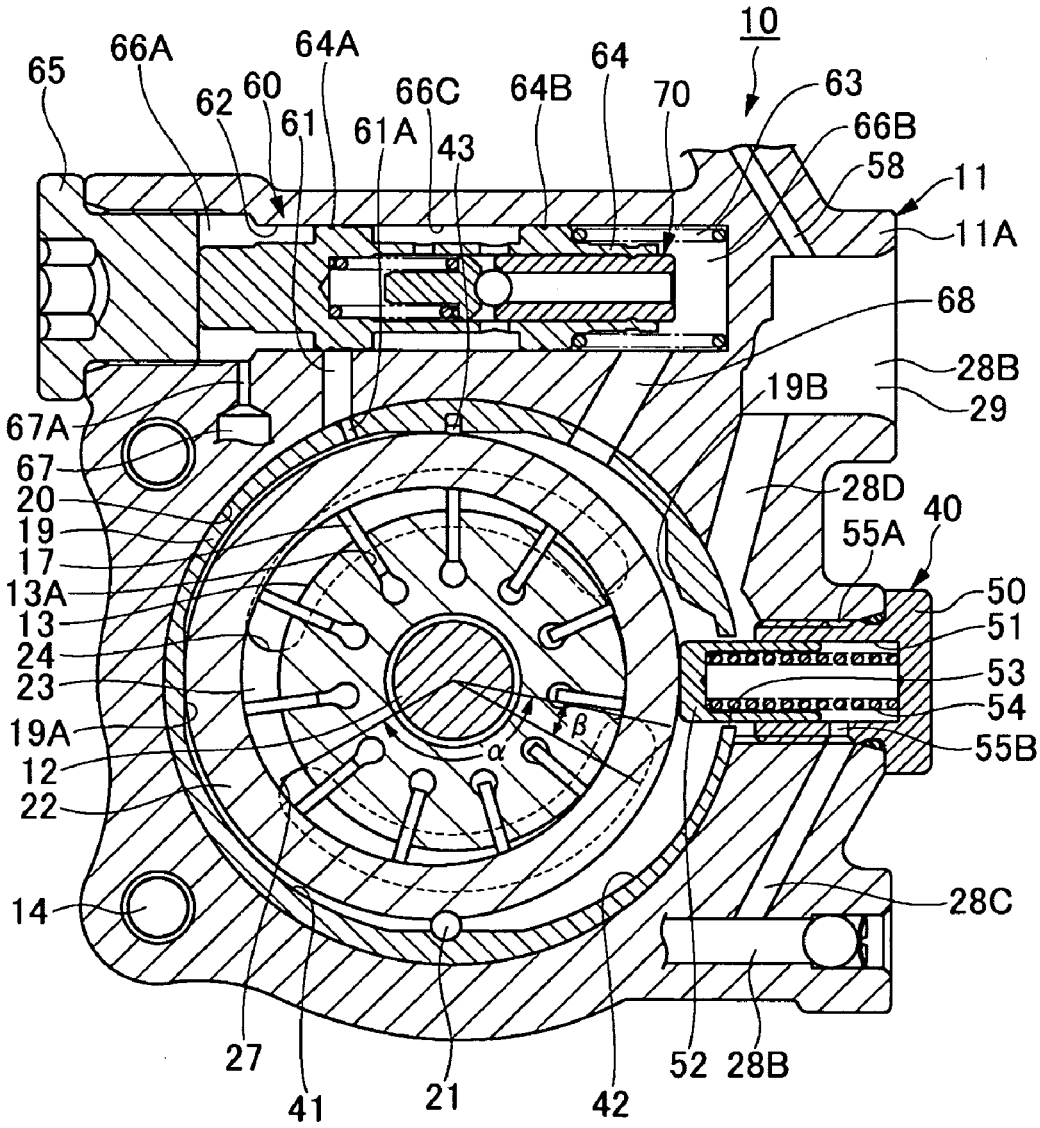
FIG. 2 is a cross-sectional view taken along line II-II of FIG. 2.

The vane pump 10 is a variable-capacity pump that is a hydraulic pressure source of a hydraulic power steering apparatus of a vehicle. As shown in FIGS. 1 and 2, the vane pump

10 has a rotor 13 which is fixed to a pump shaft 12 via a serrated coupling to be rotatably driven. The pump shaft 12 is inserted to a pump casing 11. The pump casing 11 is constructed by integrally combining a pump housing 11A and a cover 11B with a bolt 14. The pump shaft 12 is supported by a bearing 16A (ball bearing) and a bearing 16B (bush) disposed around a supporting hole 15A of the pump housing 11A and a bearing 16C (bush) disposed around a supporting hole 15B of the cover 11B. An oil seal member 16D is fitted into the supporting hole 15A.

Long-plate-shaped vanes 17 are received into grooves 13A which are formed at a plurality of circumferential positions of the rotor 13, and the vanes 17 are designed to move along the grooves 13A in a radial direction of the rotor.

A pressing plate 18 and an outer case 19 in a stacked state are fitted into a fitting hole 20 of the pump housing 11A of the pump casing 11. The pressing plate and the outer case are fixedly held from a side of the cover 11B in a state that the pressing plate and the outer case are positioned in the circumferential direction by a below-described fulcrum pin 21. One end of the fulcrum pin 21 is fixedly attached to the cover 11B.

A cam ring 22 is fitted into the above-described outer case 19 which is fixed to the pump housing 11A of the pump casing 11. The cam ring 22 having an eccentricity with respect to the rotor 13 surrounds the rotor 13, so that a pump chamber 23 is formed between the cam ring and an outer circumferential portion of the rotor 13 in a space between the pressing plate 18 and the cover 11B. A suction port 24 disposed at the cover 11B is opened in a suction region of the pump chamber 23 at an upstream side in the rotational direction of the rotor. An inlet 26 of the pump 10 is connected to the suction port 24 through a suction passage (drain passage) 25A disposed in the pump housing 11A and the cover 11B. A discharge port 27 disposed at the pressing plate 18 is opened in a discharge region of the pump chamber 23 at a downstream side in the rotational direction of the rotor. An outlet 29 of the pump 10 is connected to the discharge port 27 through a high-pressure chamber 28A and a discharge passage 28B disposed in the pump housing 11A.

Due to the construction, in the vane pump 10, the rotor 13 is rotatably driven by the pump shaft 12, and distal end portions of the vanes 17 are pressed and slid on the cam ring 22 by a centrifugal force exerted to the vanes 17 of the rotor 13. At this time, in the upstream side of the pump chamber 23 in the rotational direction of the rotor, a volume surrounded by the adjacent vanes 17 and the cam ring 22 is increased, so that an operating fluid (operating oil) is sucked through the suction port 24, and in the downstream side of the pump chamber 23 in the rotational direction of the rotor, the volume surrounded by the adjacent vanes 17 and the cam ring 22 is decreased, so that the operating fluid is discharged through the discharge port 27.

As shown in FIG. 2, in the vane pump 10, an open range a around the pump shaft 12 of the discharge port 27 is designed to be shifted by an angle of 1 at a side of a below-described second fluid pressing chamber 42.

The vane pump 10 has a discharging flow rate controller 40.

In the discharging flow rate controller 40, the above-described fulcrum pin 21 is positioned at a lowest vertical portion of the above-described outer case 19 fixed to the pump casing 11, so that a lowest vertical portion of the cam ring 22 can be supported by the fulcrum pin 21. Accordingly the cam ring 22 can have a shakable displacement within the outer case 19.

The discharging flow rate controller 40 is provided with a screwed pressing cylinder 50 in a sealed state using an O-ring, at an opposite side of a below-described first fluid pressing chamber 41 with the cam ring 22 interposed between the pump housing 11A of the pump casing 11 and the discharging flow rate controller. A branch connection line 28C branched from the discharge passage 28B is connected to an oil chamber 51 of the pressing cylinder 50, and a piston 52 inserted into the oil chamber 51 is allowed to abut against an outer surface of the cam ring 22 through a piston hole 53 formed in the outer case 19. A spring 54 is disposed as a biasing means in the oil chamber 51 of the pressing cylinder 50. The spring 54 biases the cam ring 22 through the piston 52 in such a direction that a volume (pump capacity) of the pump chamber 23 between the outer circumferential portion of the rotor 13 and the cam ring can be maximized. The piston 52 is constructed with a one-end-closed cylindrical hollow body having a cavity for receiving the spring 54.

In the outer case 19, a cam ring movement restriction stopper 19A is formed to protrude from a portion of an inner circumferential portion of the first fluid pressing chamber 41, so that a moving limit of the cam ring 22 for maximizing the volume of the pump chamber 23 can be controlled as described later. In addition, in the outer case 19, a cam ring movement restriction stopper 19B is formed to protrude from a portion of an inner circumferential portion of the below-described second fluid pressing chamber 42, so that a moving limit of the cam ring 22 for minimizing the volume of the pump chamber 23 can be controlled as described later.

In addition, in the discharging flow rate controller 40, the first and second fluid pressing chambers 41 and 42 are formed between the cam ring 22 and the outer case 19. That is, the first fluid pressing chamber 41 and the second fluid pressing chamber 42 are formed by partitioning a space between the cam ring 22 and the outer case 19 with the fulcrum pin 21 and a seal member which is disposed at a shaft-symmetric position with respect to the fulcrum pin. In the first and second fluid pressing chambers 41 and 42, both side portions between the cam ring 22 and the outer case 19 are partitioned by the cover 11B and the pressing plate 18, and the cam ring 22 abuts against the aforementioned cam ring movement restriction stoppers 19A and 19B of the outer case 19. In this case, a connection groove for connecting the portions of first fluid pressing chamber 41 partitioned in both sides of the stopper 19A and a connection groove for connecting the portions of the second fluid pressing chamber 42 partitioned in both sides of the stopper 19B are provided to the pressing plate 18.

The oil chamber 51 of the aforementioned pressing cylinder 50 is connected to the discharge passage 28B of the pump 10 through the connection line 28C. Due to this construction, in the discharge passage of the pump 10, the pressurized fluid which is discharged from the pump chamber 23 is passed through the discharge port 27 of the pressing plate 18 and the high-pressure chamber 28A of the pump housing 11A to the discharge passage 28B. Then, the pressurized fluid is charged into the oil chamber 51 through the connection line 28C from a ring-shaped groove 55A around the pressing cylinder 50 and a passage 55B formed by opening a wall of the pressing cylinder 50. In the discharge passage 28B, a main throttling portion 58 is disposed at a downstream side from a branch portion of the connection line 28C.

The discharging flow rate controller 40 (1) introduces a pressure of an upstream side of the main throttling portion 58 through a below-described diverting valve unit 60 to the first fluid pressing chamber 41 which provides a moving displacement to the cam ring 22 in a direction for minimizing the volume of the pump chamber 23, (2) introduce a pressure to a downstream side of the main throttling portion 58 from the discharge passage 28B through the branch connection line 28D and the piston hole 53 of the outer case 19 to the second fluid pressing chamber 42 which displaces the cam ring 22 in a direction for maximizing the volume of the pump chamber 23, and (3) introduces a pressure of the upstream side of the main throttling portion 58 from the discharge passage 28B through the branch connection line 28C and the passages 55A and 55B of the pressing cylinder 50 to the oil chamber 51 of the pressing cylinder 50 which provides to the cam ring 22 a moving displacement in the direction for maximizing the volume of the pump chamber 23. Due to balance of the pressures exerted to the first fluid pressing chamber 41, the second fluid pressing chamber 42, and the oil chamber 51 of the pressing cylinder 50, the cam ring 22 is moved against the biasing force of the spring 54 to change the volume of the pump chamber 23, so that the discharging flow rate of the pump 10 can be controlled.

The discharging flow rate controller 40 has the diverting valve unit 60 which is operated due to a difference in pressures between the upstream side and the down stream side of the main throttling portion 58 to control a pressure of d a fluid supplied to the first fluid pressing chamber 41 according to the discharging flow rate of the pressured fluid discharged from the pump chamber 23. More specifically, the diverting valve unit 60 is interposed between a connection line 61 connected to the first fluid pressing chamber 41 and a connection line 67 at an upstream side from the main throttling portion 58 of the discharge passage 28B. The diverting valve unit 60 cooperates with a throttling portion 61A provided to the connection line 61 to disconnect the first fluid pressing chamber 41 from the connection line 67 in a low-speed rotation region of the pump 10 and to connect the first fluid pressing chamber 41 to the connection line 67 in a high-speed rotation region thereof In the diverting valve unit 60, a spring 63 and a diverting valve 64 are received into a valve receiving hole 62 drilled on the pump housing 11A, and the diverting valve 64 biased by the spring 63 is held by a cap 65 screw-attached to the pump housing 11A. The diverting valve 64 has a valve body 64A and a diverting valve structure 64B which are in a close slide-contact with the valve receiving hole 62, so that the connection line 67 at the upstream side from the main throttling portion 58 of the discharge passage 28B is connected to a pressing chamber 66A provided to the one end side of the valve body 64A, and the connection line 68 at the downstream side from the main throttling portion 58 of the discharge passage 28B is connected through the second fluid pressing chamber 42 to a back-pressure chamber 66B in which the spring 63 provided to the other side of the diverting valve structure 64B is received. In addition, a drain chamber 66C between the valve body 64A and the diverting valve structure 64B is provided with the aforementioned suction passage (drain passage) 25A that penetrates the drain chamber, and the drain chamber is connected to a tank. The valve body 64A can open and close the aforementioned connection line 61. That is, in the low-speed rotation region where the discharge pressure of the pump 10 is low, the diverting valve 64 is set to an initial position, shown in FIG. 2, by the biasing force of the spring 63, and due to the valve body 64A, the pressing chamber 66A is closed (disconnected) from the connection line 61 to the first fluid pressing chamber 41. In the intermediate-speed and high-speed rotation regions of the pump 10, due to the highly-pressurized fluid of the connection line 67 added to the pressing chamber 66A the diverting valve 64 is moved to open (connect) the pressing chamber 66A to the connection line 61 of the first fluid pressing chamber 41 by the valve body 64A, so that the highly-pressurized fluid added from the connection line 67 to the pressing chamber 66A is introduced to the first fluid pressing chamber 41. A throttling portion 67A is provided to the connection line 67, so that pulsation at the upstream side of the main throttling portion 58 can be absorbed.

Accordingly, the pump 10 using the discharging flow rate controller 40 has discharging flow rate characteristics as follows.

(1) In a low-speed driving region of a vehicle where a speed of rotation of the pump 10 is low, a pressure of a fluid which is discharged from the pump chamber 23 to the pressing chamber 66A of the diverting valve unit 60 is still low, the diverting valve 64 is set to the initial position, and the diverting valve 64 disconnects the pressing chamber 66A from the connection line 61 to the first fluid pressing chamber 41. Therefore, the pressure of the upstream side of the main throttling portion 58 is not applied to the first fluid pressing chamber 41. However, the pressure of the downstream side of the main throttling portion 58 is applied to the second fluid pressing chamber 42, and the pressure of the upstream side of the main throttling portion 58 is applied to the oil chamber 51 of the pressing cylinder 50. As a result, due to a difference in pressure between the first fluid pressing chamber 41 and the second fluid pressing chamber 42, a pressing force of the piston 52 of the pressing cylinder 50 and the biasing force of the spring 54, the cam ring 22 is maintained at a such a position that the volume of the pump chamber 23 can be maximized, and the discharging flow rate of the pump 10 is increased in proportion to the speed of rotation(number of rotation).

(2) When the pressure which is discharged from the pump chamber 23 to the pressing chamber 66A of the diverting valve unit 60 is increased due to an increase in the speed of rotation of the pump 10, the diverting valve unit 60 moves the diverting valve 64 against the biasing force of the spring 63 to open (connect) the pressing chamber 66A to the connection line 61 to the first fluid pressing chamber 41. Therefore, the pressure of the first fluid pressing chamber 41 is increased, so that the cam ring 22 is moved toward such a position that the volume of the pump chamber 23 is reduced. Accordingly, the discharging flow rate of the pump 10 is maintained at a constant flow rate against the increase in the speed of rotation by countervailing the increase of the flow rate due to the increase of the speed of rotation with the decrease of the flow rate due to the reduction of the volume of the pump chamber 23.

In addition, in the pump 10, a relief valve 70 as a diverting valve of relieving an excessive fluid pressure at the discharging side of the pump is provided between the drain chamber 66C and the high-pressure chamber 28A and the suction passage (drain passage) 25A. In addition, in the pump 10, a lubricant supplying line 71 (not shown) in a direction from the suction passage 25A to a bearing 15C of the pump shaft 12 is drilled on the cover 11B, and a lubricant returning line 72 in a direction from a portion surrounding the bearing 15B of the pump shaft 12 to the suction passage 25B is drilled on the pump housing 11A.

In the pump 10, the pump shaft 12 is supported to the supporting hole 15A of the pump casing 11 (pump housing 11A) by the aforementioned bearing 16A (ball bearing) and bearing 16B (bush), and a pulley 80 is fixed to a protrusion 12A which protrudes outwards from the supporting hole 15A of the pump shaft 12. The pump is rotatably driven through the pulley 80 by a rotation force of an engine of a vehicle. In the pulley 80, a boss 80A is serration-coupled with a serration portion of the protrusion 12A of the pump shaft 12, and the boss 80A is pressingly fixed to an inner ring of the bearing 16A by a nut 81 screw-attached to an outer-end thread portion of the protrusion 12A. In addition, an outer ring of the bearing 16A is retained by a snap ring 82 engaged with an inner groove of the supporting hole 15A of the pump housing 11A.

Figure 3:
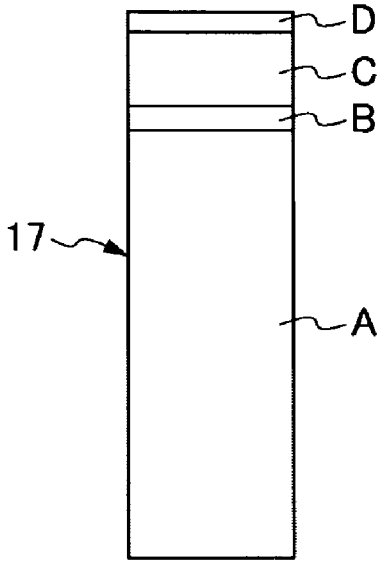
FIG. 3 is a front view showing a vane according to a first embodiment.

As shown in FIGS. 1 and 3, the pump 10 has a shape of taper in which an inner circumferential surface 92 of a hole opening portion 91 approaching an outer side (a side of a sidewall arm of the pulley 80) of the supporting hole 15A of the pump casing 11 (pump housing 11A) is enlarged outwards.

As shown in FIG. 3, in the vane pump 10, the distal end portion of the vane is constructed by forming an intermediate coating layer B, a main coating layer C, and a coloring coating layer D on a base material A of the vane 17 in this order, so that the distal end portion can be pressed and slid on the cam ring 22.

More specifically, when a high-hardness main coating layer C is formed on the distal end portion of the vane 17, the intermediate coating layer B having an intermediate hardness between a hardness of the base material A of the vane 17 and a hardness of the main coating layer C is formed between the base material A of the vane 17 and the main coating layer C. In the present embodiment, the base material A may be made of an iron-based material, for example, a high speed tool steel (SKH51) (hardness: 770 to 940 HV), the intermediate coating layer B may be made of CrN (hardness: 1800 to 2200 HV, 2.3 times the hardness of the base material), and the main coating layer C may be made of TiCrN (hardness: 2500 to 3000 HV, 1.4 times the hardness of CrN). The intermediate coating layer B with a thickness in a range of, for example, 0.4 to 0.8 μm, more preferably, 0.6 μm is physically or chemically deposited on a surface of the base material A. The main coating layer C with a thickness in a range of, for example, 2.0 to 3.0 μm, more preferably, 2.4 μm is physically or chemically deposited on a surface of the intermediate coating layer B.

In order to distinguish the distal end portion of the vane 17 from a base end portion thereof, the coloring coating layer D is formed on an outside of the main coating layer C. In the present embodiment, the coloring coating layer D may be made of TiN (hardness: 2000 to 2500 HV, 0.8 times the hardness of TiCrN) having a color of gold. The coloring coating layer D with a thickness in a range of, for example, 0.1 to 0.3 μm, more preferably, 0.2 μm is physically or chemically deposited on a surface of the main coating layer C.

According to the present embodiment, the following functions and effects can be obtained.

(a) In the vane pump 10, when the high-hardness main coating layer C is formed on the distal end portion of the vane 17, the intermediate coating layer B having an intermediate hardness between a hardness of the base material A of the vane 17 and a hardness of the main coating layer C is formed between the base material A of the vane 17 and the main coating layer C. Due to the presence of the intermediate coating layer B, a difference in hardness between the base material A of the vane 17 and the intermediate coating layer B and a difference in hardness between the intermediate coating layer B and the main coating layer C can be reduced, and an adhesion between the base material A of the vane 17 and the intermediate coating layer B and an adhesion between the intermediate coating layer B and the main coating layer C can be improved. In addition, peeling of the intermediate coating layer B and the main coating layer C can be prevented, so that an abrasion resistance and durability of the vane 17 can be improved.

(b) By constructing the base material A of the vane 17 with an iron-based material, for example, a high speed tool steel (SKH51) having a hardness of 770 to 940 HV, the intermediate coating layer B with CrN having a hardness of 1800 to 2200 HV (2.3 times the hardness of the base material A), and the main coating layer C with TiCrN having a hardness of 2500 to 3000 HV (1.4 times the hardness of CrN, a difference in hardness between the base material A of the vane 17 and the intermediate coating layer B and a difference in hardness between the intermediate coating layer B and the main coating layer C can be reduced, so that the aforementioned function and effect (a) can implemented.

(c) By forming the coloring coating layer D on an outside of the main coating layer C, a color is provided to the outmost layer of the distal end portion of the long-plate-shaped vane 17, so that the distal end portion of the vane 17 can be simply and easily distinguished from the base end portion thereof Accordingly, a workability in assembling the vanes 17 into grooves of the rotor can be improved.

(d) By forming the coloring coating layer D with TiN (hardness: 2000 to 2500 HV, 0.8 times the hardness of TiCrN, a color of gold is provided to the outmost layer of the distal end portion of the vane 17, so that the distal end portion can be simply and easily distinguished.

Figure 4:
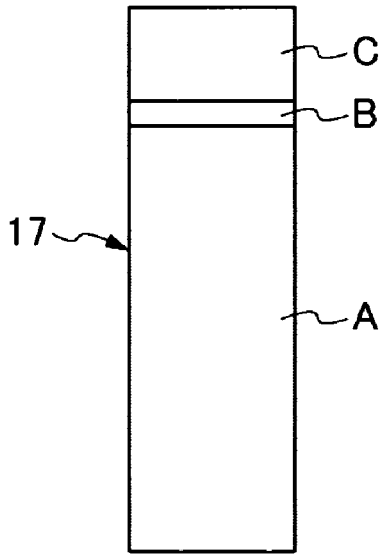
FIG. 4 is a front view showing a vane according to a second embodiment.
Figure 5:
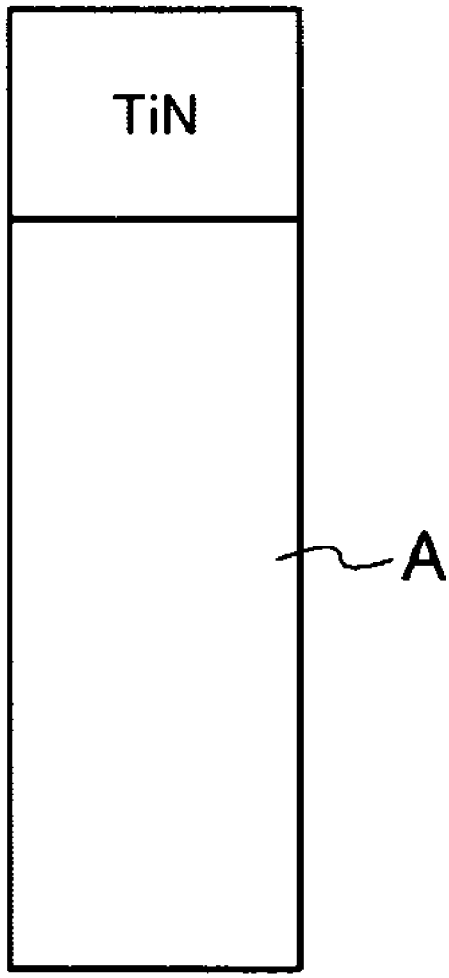
FIG.5 PRIOR ART
FIG. 5 is a front view showing a conventional vane.

FIG. 4 shows an example of a vane 17 which is obtained by removing the coloring coating layer D from the vane 17 shown in FIG. 3 and forming the intermediate coating layer B and the main coating layer C on the base material A of the vane 17 shown in FIG. 3.

As heretofore explained, embodiments of the present invention have been described in detail with reference to the drawings. However, the specific configurations of the present invention are not limited to the embodiments but those having a modification of the design within the range of the present invention are also included in the present invention.

Although the invention has been illustrated and described with respect to several exemplary embodiments thereof, it should be understood by those skilled in the art that the foregoing and various other changes, omissions and additions may be made to the present invention without departing from the spirit and scope thereof Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A vane pump in which vanes are received into grooves formed at a plurality of circumferential positions of a rotor fixed to a pump shaft, and distal end portions of the vanes are pressed and slid on a cam ring, comprising: an intermediate coating layer provided on a base material of the distal end portion of each of the vanes; a high-hardness main coating layer provided on the intermediate coating layer; and the intermediate coating layer has an intermediate hardness between a hardness of the base material of the vane and a hardness of the main coating layer;

wherein the intermediate coating layer is made of CrN, and the main coating layer is made of TiCrN.

2. The vane pump according to claim 1, wherein a coloring coating layer is formed on an outside of the main coating layer.

3. The vane pump according to claims 2, wherein a thickness of the intermediate coating layer deposited on a surface of the base material is in a range of 0.4 to 0.8 .mu.m, and a thickness of the main coating layer deposited on a surface of the intermediate coating layer is in a range of 2.0 to 3.0 .mu.m.

4. The vane pump according to claim 2, wherein a thickness of the coloring coating layer deposited on a surface of the main coating layer is in a range of 0.1 to 0.3 .mu.m.

5. The vane pump according to claim 2, wherein the base material is a high speed tool steel.

6. The vane pump according to claim 1, wherein the coloring coating layer is made of TiN.

7. The vane pump according to claims 6, wherein a thickness of the intermediate coating layer deposited on a surface of the base material is in a range of 0.4 to 0.8 .mu.m, and a thickness of the main coating layer deposited on a surface of the intermediate coating layer is in a range of 2.0 to 3.0 .mu.m.

8. The vane pump according to claim 6, wherein the base material is a high speed tool steel.

9. The vane pump according to claims 1, wherein a thickness of the intermediate coating layer deposited on a surface of the base material is in a range of 0.4 to 0.8 .mu.m, and a thickness of the main coating layer deposited on a surface of the intermediate coating layer is in a range of 2.0 to 3.0 .mu.m.

10. The vane pump according to claim 9, wherein the base material is a high speed tool steel.

11. The vane pump according to claim 1, wherein the base material is a high speed tool steel.

12. A vane pump in which vanes are received into grooves formed at a plurality of circumferential positions of a rotor fixed to a pump shaft, and distal end portions of the vanes are pressed and slid on a cam ring, comprising: an intermediate coating layer provided on a base material of the distal end portion of each of the vanes; a high-hardness main coating layer provided on the intermediate coating layer; and the intermediate coating layer has an intermediate hardness between a hardness of the base material of the vane and a hardness of the main coating layer;

wherein a coloring coating layer is formed on an outside of the main coating layer; and wherein a thickness of the intermediate coating layer deposited on a surface of the base material is in a range of 0.4 to 0.8 .mu.m, and a thickness of the main coating layer deposited on a surface of the intermediate coating layer is in a range of 2.0 to 3.0 .mu.m.

13. The vane pump according to claim 12, wherein a thickness of the coloring coating layer deposited on a surface of the main coating layer is in a range of 0.1 to 0.3 .mu.m.

14. The vane pump according to claim 12, wherein the base material is a high speed tool steel.

15. A vane pump in which vanes are received into grooves formed at a plurality of circumferential positions of a rotor fixed to a pump shaft, and distal end portions of the vanes are pressed and slid on a cam ring, comprising: an intermediate coating layer provided on a base material of the distal end portion of each of the vanes; a high-hardness main coating layer provided on the intermediate coating layer; and the intermediate coating layer has an intermediate hardness between a hardness of the base material of the vane and a hardness of the main coating layer;

wherein a thickness of the intermediate coating layer deposited on a surface of the base material is in a range of 0.4 to 0.8 .mu.m, and a thickness of the main coating layer deposited on a surface of the intermediate coating layer is in a range of 2.0 to 3.0 .mu.m.

16. The vane pump according to claim 15, wherein the base material is a high speed tool steel.

* * * * *